US006196021B1

(12) United States Patent
Wissolik

(10) Patent No.: US 6,196,021 B1
(45) Date of Patent: Mar. 6, 2001

(54) INDUSTRIAL GAS PIPELINE LETDOWN LIQUEFACTION SYSTEM

(76) Inventor: Robert Wissolik, 24 Gates Ave., Chatham, NJ (US) 07928

( * ) Notice: Subject to any disclaimer, the term of this patent is extended or adjusted under 35 U.S.C. 154(b) by 0 days.

(21) Appl. No.: 09/275,053

(22) Filed: Mar. 23, 1999

(51) Int. Cl.[7] ..... F25J 1/00

(52) U.S. Cl. ..... 62/606; 62/912; 62/913; 62/613

(58) Field of Search ..... 62/613, 606, 616, 62/912, 913

(56) References Cited

U.S. PATENT DOCUMENTS

| | | | | |
|---|---|---|---|---|
| 3,608,323 | * | 9/1971 | Salama | 62/613 |
| 3,735,601 | | 5/1973 | Stannard, Jr. . | |
| 4,054,433 | * | 10/1977 | Buffiere et al. | 62/912 |
| 4,894,076 | | 1/1990 | Dobracki et al. . | |
| 5,139,547 | | 8/1992 | Agrawal et al. . | |
| 5,220,798 | * | 6/1993 | Nagamura et al. | 62/912 |
| 5,799,505 | * | 9/1998 | Bonaquist et al. | 62/613 |

FOREIGN PATENT DOCUMENTS

| | | | | |
|---|---|---|---|---|
| 197 07 476 A1 | | 8/1998 | (DE) . | |
| 87303758 | | 4/1987 | (EP) . | |
| 93302587 | | 4/1993 | (EP) . | |
| 406241648 | * | 9/1994 | (JP) | 62/912 |

* cited by examiner

*Primary Examiner*—William Doerrler
(74) *Attorney, Agent, or Firm*—William Squire; Carella, Byrne, Bain Gilfillan

(57) ABSTRACT

A high pressure nitrogen pipeline, oxygen or plant air is diverted around a pressure letdown station to liquefy the gas or a portion of the gas for storage or air separation assist, with the remaining unused gaseous portion being returned to the pipeline downstream the letdown station. One or more heat exchangers and one or more expanders are used to cool down the gas and liquefy it. A generator or compressor may be coupled to the expanders employing companders for generating power or for further compression of the pipeline gas. In a further embodiment, natural gas is cooled to assist in liquefying the nitrogen by drying the natural gas and forming two streams wherein carbon dioxide is removed from a smaller stream which is applied to cascaded heat exchangers and the larger stream is expanded to further cool it. The two streams are applied to the heat exchangers for cooling and liquefying nitrogen gas or other merchant gas applied to the heat exchangers from a pipeline or other source. A portion of the nitrogen gas is tapped from the heat exchangers for expansion and the remaining portion cooled through the remaining heat exchangers with both portions applied to a separator. The separator vapor output is applied to the heat exchangers for cooling the nitrogen and the liquid gas is pumped to storage.

21 Claims, 6 Drawing Sheets

INDUSTRIAL GAS PIPELINE LETDOWN LIQUEFACTION SYSTEM

CROSS REFERENCE TO RELATED APPLICATION

Of interest is copending commonly owned application Ser. No. 09/262,259 entitled Natural Gas Letdown Liquefaction System filed Mar. 4, 1999 in the name of Robert Wissolik.

FIELD OF THE INVENTION

The present invention relates to the manufacture of merchant liquid nitrogen, oxygen, argon, carbon monoxide and plant air utilizing the refrigeration capacity of high pressure gas expansion.

BACKGROUND

Traditionally industrial gases used in larger quantities as a utility have been compressed and sent down pipelines under high pressure to transport the gas to one or more industrial gas customers. The high pressure in the pipeline is used for transport and gas storage. When the gas has arrived at it's use point, the pressure of the industrial gas is reduced by passing it through one or more control valves and/or pressure regulators to it's final pressure for consumption. Typically, one or more of the industrial gas customers will need the gas at a much lower pressure than is required by the transportation pipeline. The available energy and the chilling effect from the reduction in the pressure of the industrial gas to be consumed is wasted in the control valves and pressure regulators for the gas sent to the customers. Furthermore, due to the nature of the pipeline controls, some of the industrial gas manufactured and compressed into the pipeline must be vented to the atmosphere through control valves and pressure regulators when the customer demand does not closely match the design capacity of the pipeline compressors. Centrifugal pipeline compressors, due to seasonal cooler ambient temperatures also experience large increases in capacity. The available energy and chilling capacity in this gas is also wasted.

While industrial gas companies have compressed industrial gas into merchant liquid units for many years, none have attempted to recover the potential merchant capacity inherent in the high pressure transportation pipelines supplying lower pressure industrial gas customers. The letdown liquefaction units described herein will opportunistically take advantage of the ability of the pressure reduction already occurring to make merchant liquid products, which include liquid nitrogen, liquid oxygen, liquid air, liquid carbon monoxide and liquid argon.

SUMMARY OF THE INVENTION

While a number of industrial gas companies have taken advantage of excess capacity, pressure reduction inside their air separation units to make extra merchant liquid gases, none have utilized the inherent capacity of pressure letdown stations outside the air separation unit cold boxes as in the present invention. The present invention is a recognition of the need to utilize such capacity of the pressure letdown stations to make such extra merchant liquid gases.

Among the objects and advantages of the present invention is to provide systems for producing merchant liquid gases such as nitrogen, oxygen, argon, carbon monoxide and plant air by employing the refrigeration capabilities of higher pressure industrial gas expansion, plant air expansion and/or natural gas expansion, and the energy recovered from letting down pressure through a letdown liquefaction process instead of a control valve or a pressure regulator.

It is among the further objects and advantages of the present invention to provide systems for producing liquid merchant gases with reduced power consumption by recovering both refrigeration and energy from the high pressure industrial gas stream.

An additional object and advantage of the present invention to provide systems for producing liquid merchant gases with additional liquid reflux generated by the inventive novel systems that increases the amount of product argon and oxygen produced in an air separation unit.

A further object and advantage of the present invention is to provide systems for producing liquid merchant gases with reduced capital expenditure resulting from recovering both refrigeration and energy from an industrial gas stream.

An additional object and advantage of the present invention is to provide systems for producing liquid merchant gases that utilize excess gaseous production capacity under pressure which is currently wasted by venting to atmosphere. The systems take advantage of overcapacity commonly found in the industrial gas business.

An additional object and advantage of the present invention is to provide systems for producing liquid merchant gases that provide supplemental storage capacity to the transport pipelines as liquid product.

A system for recovering refrigeration and energy from a relatively high pressure air or an air component gas supplied to a letdown station having a lower pressure output stream according to the present invention comprises heat exchanger means for receiving and cooling a pressurized air or air component gas and first expander means responsive to cooled pressurized gas at an output of the heat exchanger means applied thereto for expanding and further cooling the pressurized gas and for supplying a first portion of the further cooled pressurized gas to said heat exchanger means for the cooling of the received pressurized gas and for liquefying a second portion of the further cooled pressurized gas.

The heat exchanger means preferably has an input for receiving the pressurized air or gas upstream the letdown station and an output for supplying the first portion downstream the letdown station and storage means for storing the second portion.

One embodiment includes separator means responsive to the expanded cooled gas for separating the first and second portions.

A further embodiment further includes an air separation means and means for supplying a third portion of the liquefied gas to the air separation means for assisting in separating air into component gases.

The pressurized gas is preferably selected from the group consisting of air, nitrogen, argon, carbon monoxide and oxygen.

The pressurized gas is air in a further embodiment and further includes adsorbing means for drying and removing carbon dioxide from the pressurized air and for supplying the dried air to the heat exchanger means.

A further embodiment includes means for regenerating the adsorbing means with the first portion of the gas outputted from the heat exchanger means.

A still further embodiment includes means coupled to the expander means for generating power. Preferably a further embodiment includes compressor means coupled to the expander means for compressing at least one of the received gas applied to the heat exchanger means and supplied first portion.

A preferred embodiment further includes means responsive to pressurized natural gas applied to an input thereto for cooling applied natural gas and applying the cooled natural gas to the heat exchanger means for cooling the air or air component.

In a still further embodiment, means are provided for dividing the pressurized natural gas into a first relatively large stream and a relatively smaller second stream, the heat exchanger means comprising cascaded heat exchangers, a first portion of the cascaded heat exchangers for successively cooling and liquefying the smaller second stream, second expander means for expanding and cooling the natural gas larger first stream at an output of a second portion of the heat exchangers and for applying the expanded cooled natural gas first larger stream to a third portion of the cascaded heat exchangers for cooling the natural gas second smaller steam, and means for applying the liquefied natural gas to the first portion of the cascaded heat exchangers for cooling the smaller second stream and for applying the pressurized air or air component gas to a fifth portion of the heat exchangers including the first portion of the cascaded heat exchangers for cooling the air or air component by the cooled natural gas.

Preferably separation means are included for separating cold vapor from liquid in the liquefied air or air component gas, and means for applying the cold vapor to the fifth portion of heat exchangers for cooling the air or air component gas.

In a further embodiment, the first expander means is for expanding and liquefying a portion of the air or air component at the output of a sixth portion of the cascaded heat exchangers, the means for separating cold vapor for separating cold vapor from the last mentioned liquefied portion and applying the cold vapor from the liquefied last mentioned portion to the fifth portion of heat exchangers.

Preferably compressor means are driven by the first expander means for compressing warmed air or air component gas output of the fifth portion of cascaded heat exchangers and for returning the compressed warmed air or air component gas to the lower pressure output stream.

Drying means are also preferably included for drying the natural gas prior to formation of the first and second streams and means included for regenerating the dryer means with the larger first portion of natural gas after it is expanded by the second expander means and applied to the third portion of the heat exchangers.

In a further embodiment, $CO_2$ absorber means are included for removing $CO_2$ from the natural gas smaller second stream prior to applying the smaller stream to the cascaded heat exchangers and means for regenerating the $CO_2$ absorber means with the smaller second stream after it is passed through the first portion of cascaded heat exchangers in a direction in which it is cooled and then through the first portion of cascaded heat exchangers in a reverse direction in which it is warmed.

Preferably in a further embodiment the first expander means comprises a first expander and a second expander, the heat exchanger means comprising cascaded first, second and third heat exchangers, the pressurized air or air component gas being applied successively to the first, second and third heat exchangers in that order, the first expander for expanding and cooling the first portion at the output of the first heat exchanger and applying the expanded cooled gas successively to the second and first heat exchangers in that order for cooling a third portion of the gas applied to the first and second heat exchangers, the second expander for expanding and liquefying a fourth portion of the gas at the output of the cascaded first and second heat exchangers and including means for applying a cold vapor portion of the output of the second expander to the third, second and and first cascaded heat exchangers in that order for cooling said pressurized gas applied to the cascaded heat exchangers and including throttling valve means for liquefying a fifth portion of said air or air component gas, said liquefied fourth and fifth portions forming said second portion.

DETAILED DESCRIPTION

Figure 1:
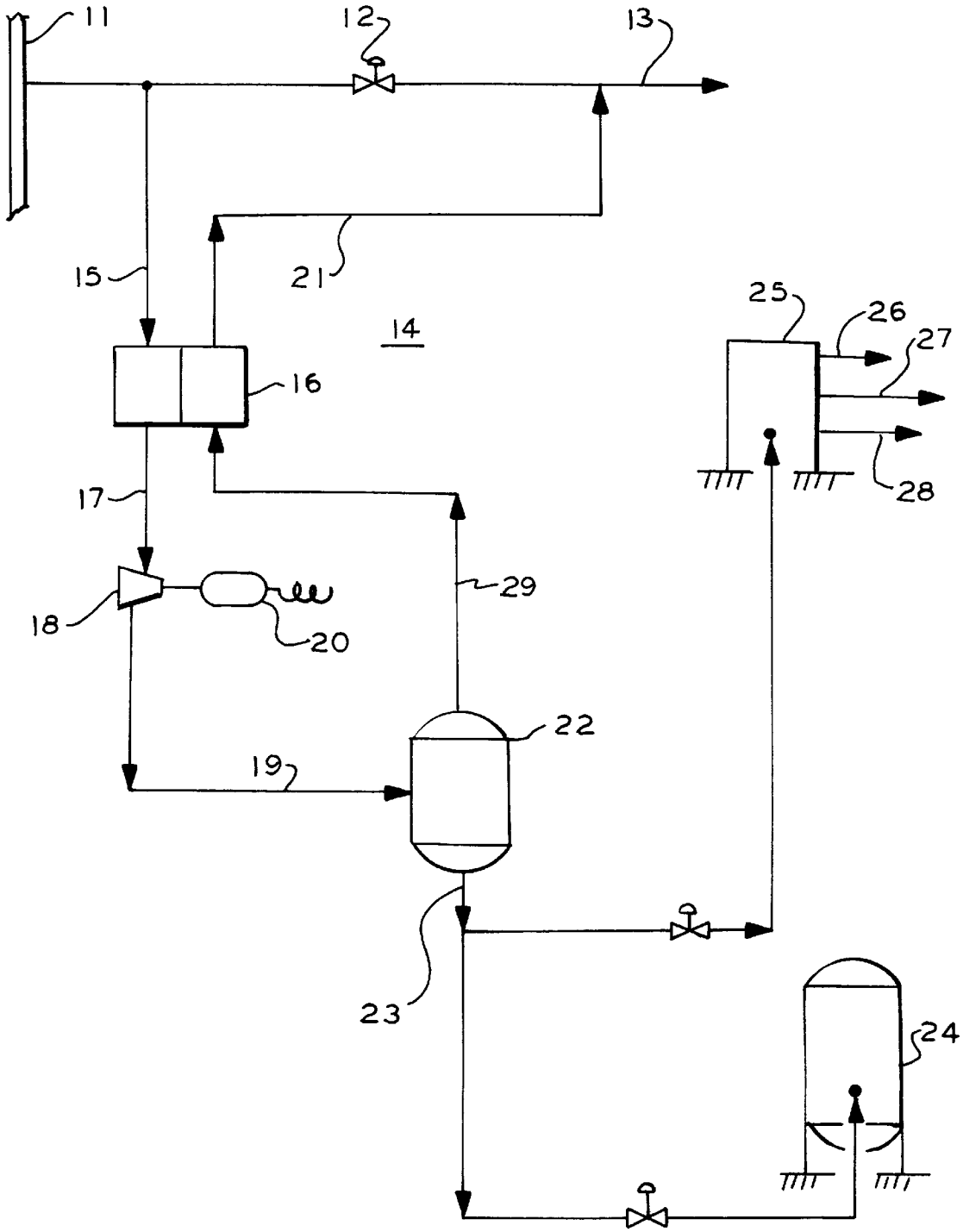
FIG. 1 is a process flow diagram showing a basic liquefaction unit using nitrogen gas from a transportation pipeline to make liquid nitrogen.

Referring now to the drawings in detail and FIG. 1 in particular, nitrogen gas is being transported down a pipeline 11 under high pressure, typically 250 to 600 psig as depicted by stream 11'. The pressure for different systems will vary, but for this example, the pressure is set to 400 psig, which is a common pressure level seen in nitrogen pipelines. Current practice would have the nitrogen gas reduced in pressure through pressure regulator or regulators at letdown station 12, to the customer's requirement at stream 13. In this example the customer requires the nitrogen gas of stream 13 at 150 psig. When a letdown liquefaction unit 14 taps into the high and low pressure levels of the nitrogen line, nitrogen gas can be directed around the letdown station 12 into the letdown liquefaction unit 14. The diversion starts with stream 15. Typically nitrogen gas in stream 15 is free of moisture and carbon dioxide which enables it to be liquefied directly without purification. Stream 15 first enters heat exchanger 16 where it is cooled against exiting cold nitrogen vapors being rewarmed to recover refrigeration. The vertical line in the heat exchanger 16 represents fluid isolated channels that are thermally conductive coupled. Such vertical lines are representative of fluid isolated channels in the heat exchangers in the various figures. Upon leaving the exchanger 16, the cooled nitrogen gas in stream 17 has reached a temperature of approximately −220 degrees F. This gas is then fed into an expander 18 which extracts energy from the nitrogen stream as the pressure is reduced to the lower level. In the process of energy removal, the temperature of the gas stream 17 is reduced in expander 18 expanded output stream 19. Furthermore, a small fraction of the expander 18 exhaust gas stream 19 is liquefied. In this example, stream 19 has approximately 4% liquid nitrogen.

The energy recovered from the expander 18 can be used to generate electricity in the expander brake 20 as is done in this example. Alternate uses of this energy could be designed which utilize a compressor brake (not shown) on the expander 18 that compress either input stream 15 from pipe 11 or output stream 21 to stream 13. This enhances the pressure ratio across the expander 18. The higher pressure ratios would further enhance the refrigeration capacity at the system level of liquefaction unit 14 resulting in more liquid nitrogen production. An oil brake (not shown) could also be used on the expander 18 if liquefaction unit 14 is relatively small.

After exiting the expander 18, mixed phase stream 19 enters a process separator 22 to separate the gas and liquid phases. Product stream 23 exits the separator 22 and is fed to nitrogen liquid storage tank 24 either by gravity flow, or by pump (not shown). Alternately, the liquid in stream 23 from the separator 22 could be used to liquid assist an air separation unit 25 stream 23' via valve 23" to make liquid nitrogen 26, liquid oxygen 27 and liquid argon 28 at air separation unit 25. Air separation unit 25 could also make only liquid nitrogen if it was a nitrogen unit. The purity of product stream 23 is slightly worse than the feed stream 15. In this example, the oxygen content in the nitrogen stream 23 is 4 ppm with gas entering the liquefaction unit 14 as stream 15 having an oxygen content of approximately 2 ppm. Cold gas stream 29 exiting the process separator 22 at approximately minus 269 degrees F. cools incoming nitrogen gas in the heat exchanger 16. Then it is exhausted as stream 21 into the low pressure pipe main stream 13 which supplies nitrogen to the customer.

Figure 2:
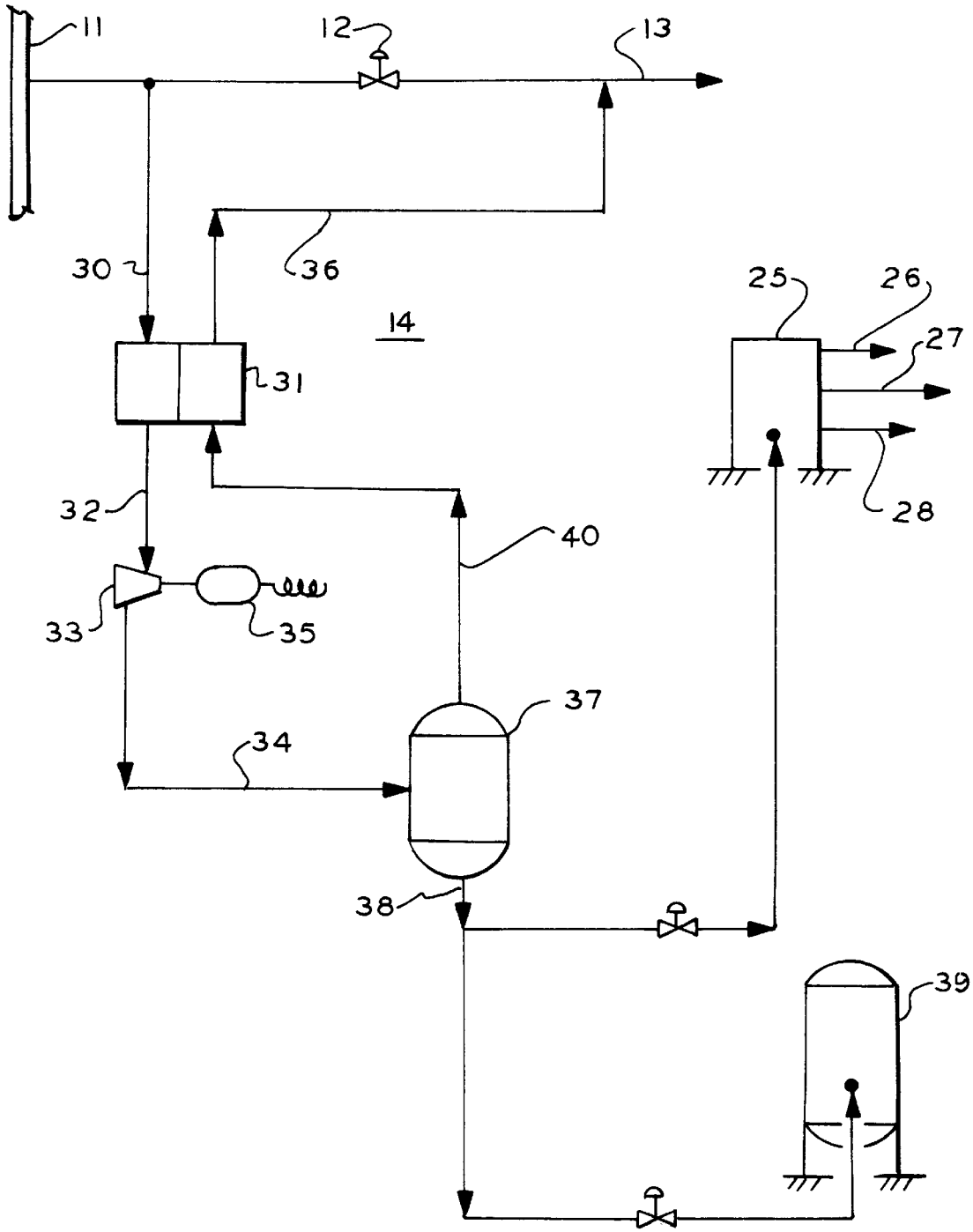
FIG. 2 is a process flow diagram showing a basic liquefaction unit using oxygen gas from a transportation pipeline to make liquid oxygen.

In FIG. 2, oxygen gas is being transported in pipeline 11 under high pressure, typically 250 to 600 psig, and tapped at stream 11'. The pressure for different systems will vary, but for this example the pressure is set at 300 psig which is a common pressure level seen in oxygen pipelines. Current practice would have the oxygen gas reduced in pressure at the control valve of letdown station 12 to the customer's requirements at stream 13. In this example, the customer requires oxygen gas at 25 psig. Letdown liquefaction unit 14' taps into the high and low pressure levels of the oxygen line of pipe 11 at respective streams 30 and 36. Oxygen gas is directed around the letdown station 12 by streams 30 and 36 into the letdown liquefaction unit 14'. The diversion starts with stream 30. Typically oxygen gas in stream 30 is free of moisture and carbon dioxide which enables it to be liquefied directly without purification. Stream 30 first enters heat exchanger 31 where it is cooled by exiting cold oxygen vapors being rewarmed to recover refrigeration. Upon leaving the exchanger 31, the cooled oxygen gas in stream 32 has reached a temperature of approximately minus 206 degrees F. This gas is then fed into an expander 33 which extracts energy from the oxygen stream 32 as the pressure is reduced to the lower level. In the process of energy removal, the temperature of the gas stream is reduced. Furthermore, a small fraction of the gas stream is liquefied at the expander 33 exhaust stream 34. In this example, stream 34 contains approximately 10% liquid oxygen.

The energy recovered from the expander 33 can be used to generate electricity in an expander brake 35 as is done in this example. Alternate uses of this energy could be designed which utilize a compressor brake (not shown) that compresses either stream 30 or stream 36 to enhance the pressure ratio across the expander 33. The higher pressure ratios would further enhance the liquefaction unit's refrigeration generation capacity resulting in more liquid oxygen production. An oil brake (not shown) could also be used on the expander if the liquefaction unit 14' is small. After exiting the expander 33, mixed phase stream 34 enters a process separator 37 to separate the gas and liquid phases. Liquid product stream 38 exits the separator 37 and is fed to oxygen liquid storage tank 39 either by gravity flow or by pump (not shown). In the alternative, the liquid could be used to liquid assist air separation unit 25 through valve 38' to make liquid nitrogen, liquid oxygen and liquid argon. The purity of stream 38 is enhanced when liquefying oxygen. Cold gas exiting the process separator 37, stream 40, at approximately minus 277 degrees F. is used to cool incoming oxygen gas in heat exchanger 31 before being exhausted into the low pressure pipe main stream 13 which supplies oxygen to the customer.

Figure 3:
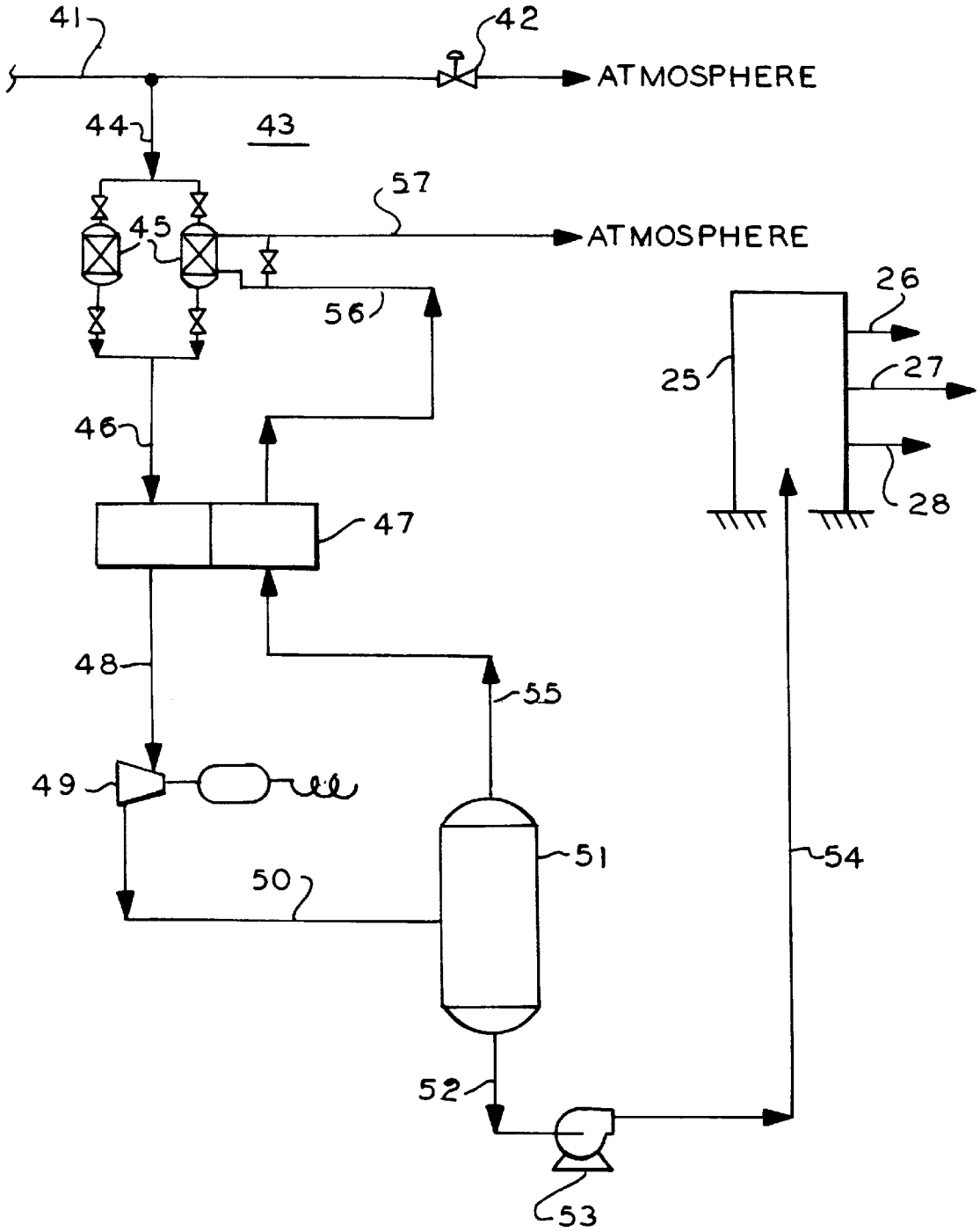
FIG. 3 is process flow diagram showing a basic liquefaction unit using plant air from a plant air system to produce liquid air.

In FIG. 3, plant air is being transported through an in-house industrial plant air pipeline system, stream 41, which consistently has excess capacity. Some air will be constantly vented to the atmosphere through control valve 42 to maintain pressure below a preset level. This air can now be utilized to make merchant liquid through the installation of letdown liquefaction unit 43. In this example, plant air is being used at approximately 120 psig in stream 44 tapped into stream 41. Instead of being vented to atmosphere directly, excess air is diverted into two absorbers 45 of the letdown liquefaction unit 43 for moisture and carbon dioxide removal. All the air is sent to the absorbers 45. After exiting the absorbers 45, the dried warm air stream 46 is fed into the heat exchanger 47 where it is cooled by cold air vapors in stream 55 being returned for refrigeration recovery. Upon leaving the exchanger 47, the cooled air in stream 48 has reached a temperature of approximately minus 257 degrees F. The cool gas is then fed into expander 49 that extracts energy from the air stream as the pressure is reduced to approximately 2.5 psig. In the process of energy removal, the temperature of the gas stream 48 is reduced to about minus 311 degrees F. and a small portion of expander 49 output stream 50 (8%) is liquefied. The liquid will be enriched in oxygen and argon, the oxygen content being approximately 47% and the argon content being approximately 1.4%.

After exiting the expander 49, mixed phase stream 50 enters process separator 51 which separates the gas and liquid phases. Product stream 52 (enriched air) exits the separator 51 and is pumped by pump 53 as stream 54 into an air separation unit 25 as liquid assist. The liquid assist enables the air separation unit 25 to produce additional liquid nitrogen 26, liquid oxygen 27, and liquid argon 28. The gas stream 55 from the separator at approximately minus 311 degrees F. is used to cool the incoming air in stream 46 in the heat exchanger 47 before being exhausted as stream 56 from the exchanger 47. Some of this gas is diverted to regenerate the dryer absorbers 45 by stream 56. Then all the returning gas exits the letdown liquefaction unit 43 to the atmosphere as stream 57. The regeneration gas is also vented to atmosphere completing the discharge of air through the letdown liquefaction unit 43.

Other uses for the enriched liquid air product are also possible. These schemes have not been shown. The enriched air product can be used as liquid storage for backing up the plant air system. When mixed with liquid nitrogen in the proper amounts, the mix is vaporized under pressure to supply the plant air system with gas when the compressors and/or dryers are down and not operational. Another use for the enriched air product would be to use vaporized and warmed enriched air product to augment air feed into industrial burners (not shown) for further energy savings in the burners. A final use not shown would involve the use of this product as a chemical feed to chemical processes that currently use air feed.

Oxygen gas from a pipeline or nitrogen gas from a pipeline can be substituted for plant air in FIG. 3. With these gases, water dryers and carbon dioxide absorbers (not shown) are omitted, but the remaining equipment is the same. This cycle is utilized for oxygen and nitrogen as with plant air when excess compressor capacity is available and the unit compressor controls are venting the gas constantly to the atmosphere.

Figure 4:
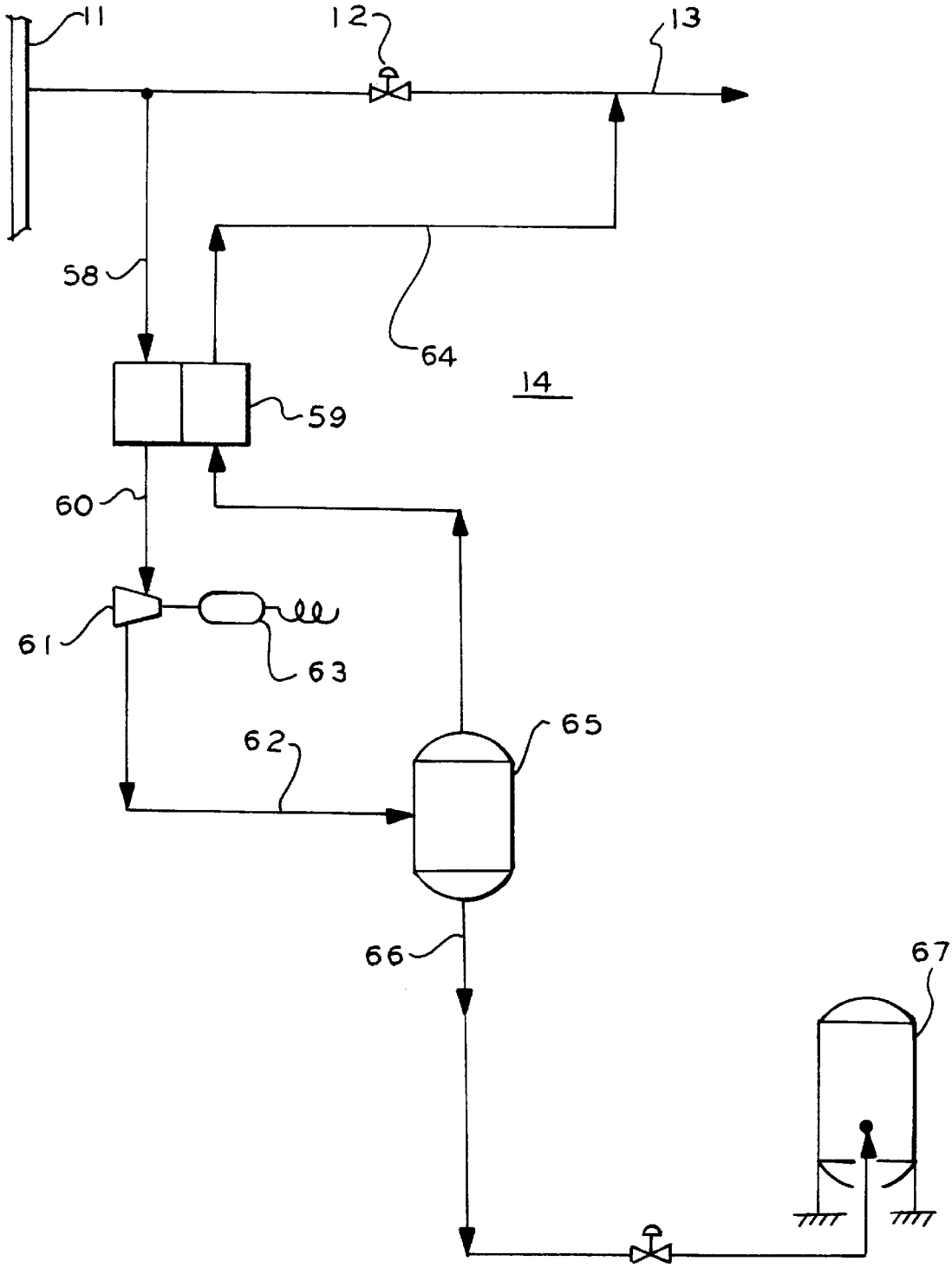
FIG. 4 is a process flow diagram showing a basic liquefaction unit using carbon monoxide gas from transportation pipelines to make liquid carbon monoxide.

In FIG. 4, carbon monoxide gas is being transported down a pipeline 11 under high pressure, typically 250 to 600 psig 11'. The pressure for different systems will vary, but for this example the pressure is set at 400 psig. It has also been assumed for this example that the carbon monoxide stream has been purified by a cryogenic process which insures that stream 11' is free of moisture and carbon dioxide. Current practice would have the carbon monoxide gas reduced in pressure to the customer requirements in stream 13, which in this example is at 25 psig. When a letdown liquefaction unit 14" taps into the high and low pressure levels of the carbon monoxide pipeline, carbon monoxide gas can be directed around the letdown station 12 into the letdown liquefaction unit 14". The diversion starts with stream 58. Stream 58 first enters heat exchanger 59 where it is cooled by cold carbon monoxide vapors stream 68, stream 68 being warmed in heat exchanger 59 to recover refrigeration. Upon leaving the exchanger 59, the cold carbon monoxide in output stream 60 has reached a temperature of approximately minus 203 degrees F. This is then fed into expander 61, which extracts energy from the carbon monoxide stream as the pressure is reduced to the lower level. In the process of energy removal, the temperature of the gas is reduced. Furthermore, a small fraction of the gas stream is liquefied at the expander 61 exhaust in stream 62. In this example, stream 62 gas contains approximately 10% liquid carbon monoxide.

The energy recovered from the expander 61 can be used to get electricity in the expander brake 63 as is done in this example. An expander 61 using a compressor 63' (shown in phantom) could also be used to compress either input stream 58 from stream 11' or heat exchanger 59 output stream 64 to enhance the pressure ratio across the expander 61. The higher pressure ratio would further enhance the liquefaction unit's 14" refrigeration capacity resulting in more carbon monoxide liquid production. If the liquefaction unit 14" is small, an oil brake (not shown) could be used to dissipate the expander energy.

After exiting the expander 61, mixed phase stream 62 at minus 292 degrees F. enters process separator 65 to separate the gas and liquid phases. Liquid product stream 66 exits separator 65 and is fed to liquid carbon monoxide storage tank 67. Proper safety precautions need to be followed with carbon monoxide storage. The liquid can be used to backup the pipeline 11 with ambient vaporizers or can be vaporized against a nitrogen stream to be liquefied. These options have not been shown in the figure, but are mentioned to clarify the disposition of the liquid carbon monoxide. Cold carbon monoxide vapors stream 68 exits the separator 65 and enters heat exchanger 59 where it is warmed to ambient temperatures by incoming carbon monoxide gas steam 58 being cooled. Stream 64 from the exchanger 59 returns to the low pressure pipe main stream 13 which supplies carbon monoxide to the customer.

Figure 5:
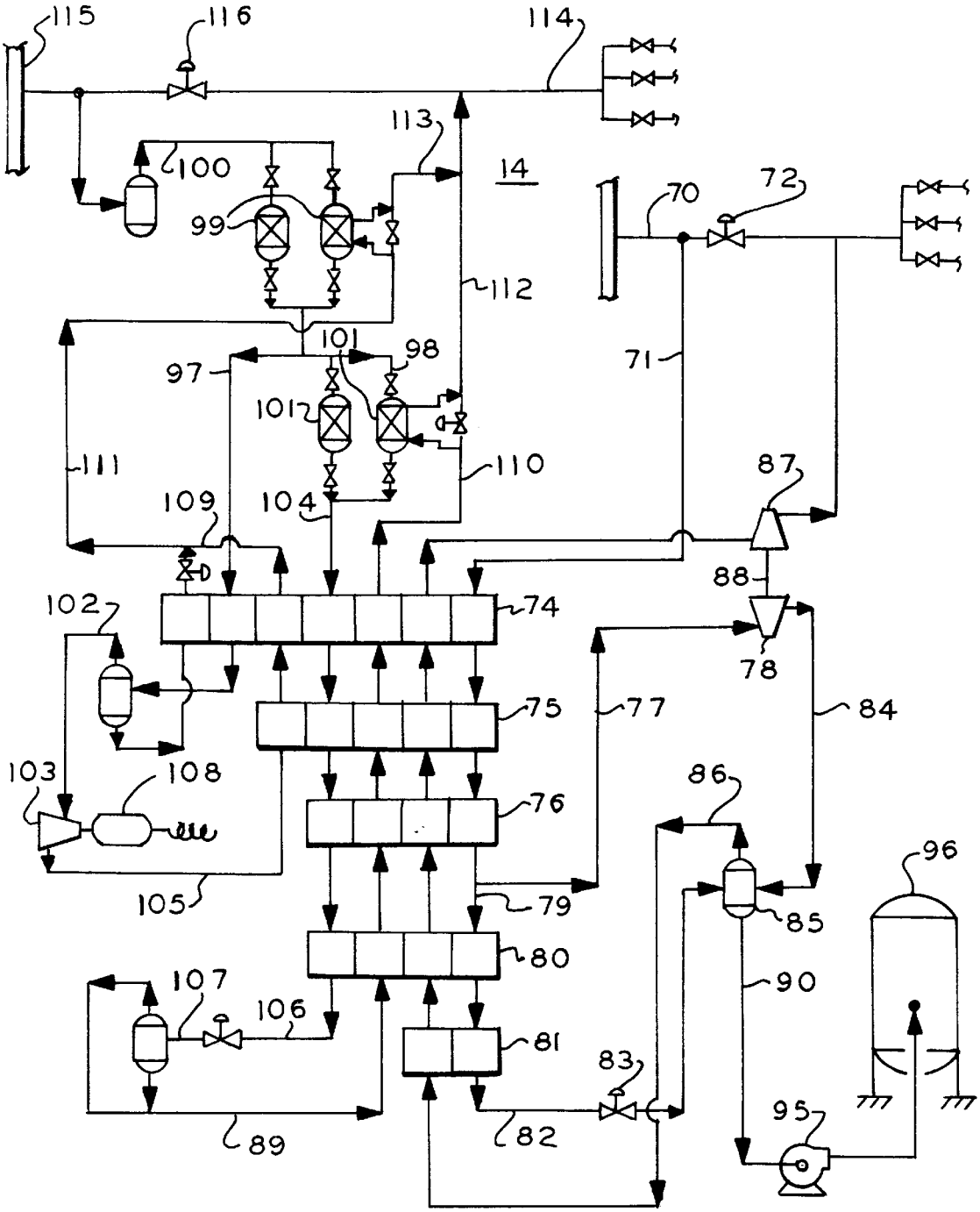
FIG. 5 is a process flow diagram showing a basic liquefaction unit utilizing both nitrogen gas and natural gas to produce liquid nitrogen product.

The process in FIG. 5 presents a processing scheme were both natural gas and nitrogen letdown stations exist on the same site. In this example, dry, carbon dioxide free nitrogen gas at a pressure of 515 psig in a nitrogen pipeline stream 70 is fed into the letdown liquefaction unit 120. Nitrogen stream 71 from stream 70 is successively cooled in cascaded heat exchangers 74, 75, and 76 to approximately minus 170 degrees F. after being diverted from letdown station 72. A larger portion of nitrogen from stream 71 successively passed through exchangers 74–76 respectively is tapped as stream 77 and is fed to nitrogen expander 78 to make refrigeration and recover energy from the high pressure nitrogen. The smaller nitrogen stream 79 from exchanger 76 is kept under pressure to be further cooled in heat exchangers 80 and 81.

Exiting heat exchanger 81, nitrogen stream 82 at approximately minus 265 degrees F. is sent through a letdown valve 83 where most of the stream is liquefied. A small fraction of stream 84 exiting the expander 78 at approximately minus 305 degrees F. is also liquid nitrogen. Both streams 84 and 82 are mixed in separator 85 at 20 psig where gas and liquid are separated. The separator output cold nitrogen gas stream 86 is sent successively through heat exchangers 81–74, inclusive, to recover refrigeration where it is outputted as stream 86'. Stream 86' is compressed in the expander brake 87 of nitrogen compander 88 to 30 psig for use by the nitrogen customer downstream letdown station 72.

Cooled natural gas hydrocarbon stream 89 from separator 89' from streams 106, 107 inputted to the separator 89' is applied to heat exchangers 80, 76, 75 and 74, in this successive order, to cool the nitrogen streams. Liquid nitrogen stream 90 from the separator 85 at low pressure is transferred by pump 95 to tank 96 at high pressure, or sent to an air separation unit (not shown) where liquid nitrogen, liquid oxygen and or liquid argon can be extracted. In this example, stream 90 is pumped to liquid nitrogen storage tank 96.

The high pressure natural gas in pipeline main 115 is tapped to form stream 115' which is tapped to form stream 115". Stream 115" is applied to separator 100'. Natural gas stream 100 from separator 100' in the letdown liquefaction unit 120 is split into two streams, larger stream 97 and smaller stream 98 after it has been dried in two dryers 99. The larger stream 97 is used for expansion and the smaller stream 98 is kept under pressure to be liquefied. Stream 100 at 485 psig is dried by dryers 99 to remove water. Then stream 100 is split into the streams 97 and 98. Dried smaller stream 98 is fed to two parallel carbon dioxide absorbers 101 for carbon dioxide removal forming stream 104. Streams 97 and 104 are fed to separate heat exchanger 74 channels to be separately cooled. Stream 102 is cooled stream 97 after separation by separator 102'. A second separator 102' output separated stream 102" is returned to heat exchanger 74. The separator 102' output stream 102 enters natural gas expander 103 at approximately minus 29 degrees F. to be cooled and to remove energy forming stream 105. Small amounts of liquid natural gas hydrocarbons forming stream 102" are removed before entering the expander 103 to protect the expander. The refrigeration of stream 102" is recovered in heat exchanger 74. The stream 105 is returned successively to exchangers 75 and 74 in this order to recover refrigeration therefrom. The steams 105 and 102" are outputted from the heat exchanger 74, with the stream 105 forming exchanger output stream 109. The stream 102" outputted by exchanger 74 and stream 109 are combined to form stream 111.

The smaller natural gas stream 104 from absorbers 101 is further cooled successively in heat exchangers 74 and 75, then exits heat exchanger 75 at approximately minus 158 degrees F. It is cooled in heat exchangers 74 and 75 by the natural gas expander exhaust stream 105 at 45 psig and minus 160 degrees F. The smaller stream 104 is further cooled in heat exchangers 76 and 80 forming stream 106. The pressure is let off the cooled natural gas stream 106 by valve 106'. The pressure let off by valve 106' results 10 in partial liquefaction at approximately minus 220 degrees F. and 45 psig forming stream 107. Stream 107 is applied to separator 89' forming output stream 89. Stream 89 has its refrigeration recovered in exchangers 80–74 in this order forming warmed exchanger output stream 1 10.

In this example, the natural gas expander energy in expander 103 is recovered by electrical generator expander brake 108. It could also have been recovered by a compressor brake (not shown) to compress natural gas at either of streams 100 (at the output of separator 100') or 109 (at the output of exchanger 74).

After exiting the heat exchangers 80–74 in this order, the smaller natural gas stream 110 formed by stream 89 is used to regenerate the carbon dioxide adsorbers 101 forming stream 112. The larger warmed natural gas stream 111 from exchanger 74 formed by stream 105 is used to regenerate the moisture dryers 99 and forms stream 113. The two natural gas streams 112 from stream 110 and 113 from stream 111 are then recombined and fed to the low pressure main downstream from the letdown station 116 into stream 114 which feeds the natural gas customers. Thus the natural gas in the high pressure main 115 is directed around letdown station 116 to assist in making liquid nitrogen stream 90 from the letdown liquefaction unit 120.

Figure 6:
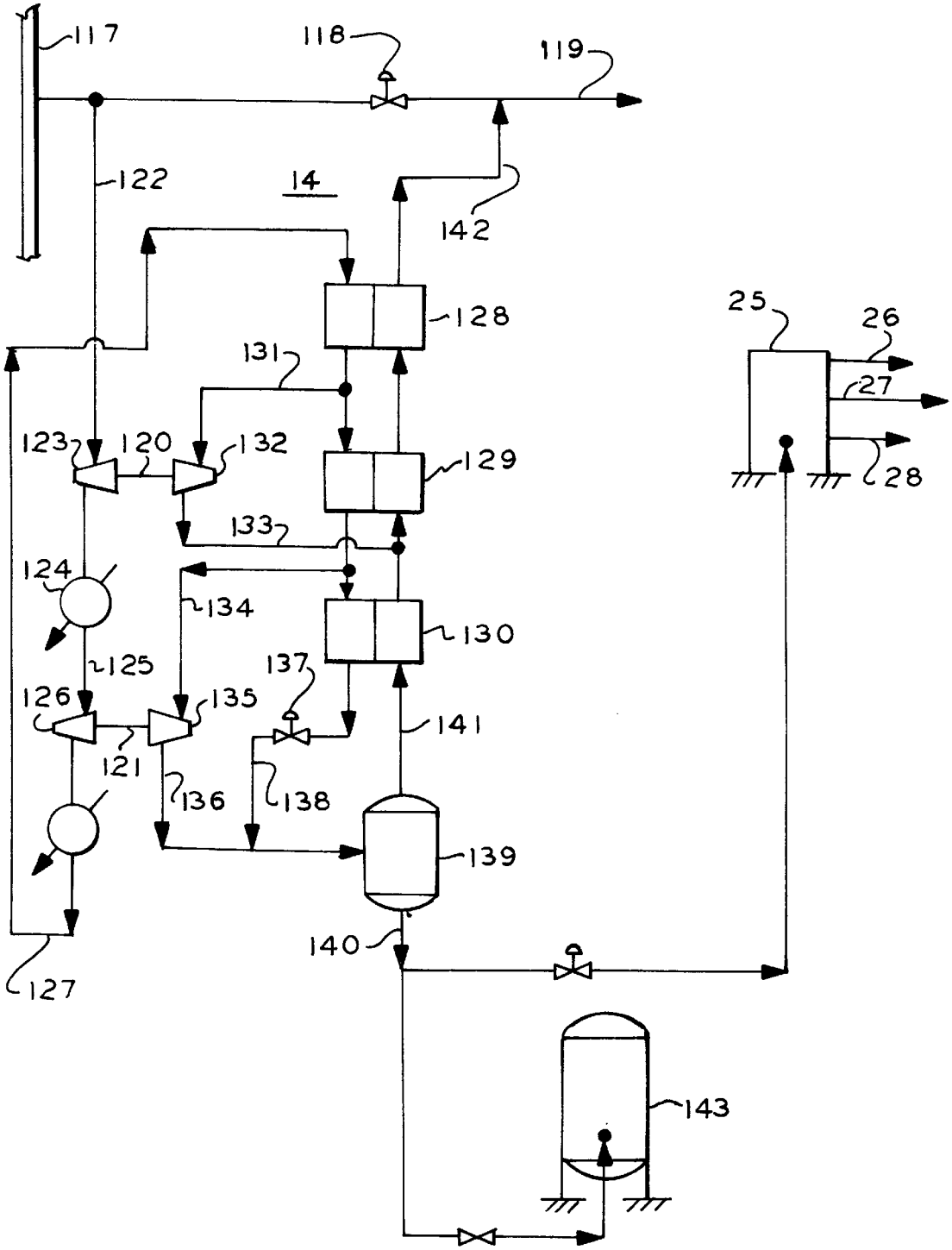
FIG. 6 is a process flow diagram showing a more complex liquefaction unit utilizing nitrogen gas and two companders to produce liquid nitrogen product. Liquid oxygen, liquid argon and enriched liquid air are also potential products from this process.

In FIG. 6, gaseous nitrogen is transported down a pipeline 117 under high pressure and is tapped at stream 117'. A nitrogen customer takes gas off the pipeline at stream 119. In this example, the gas is nitrogen. But it could also be oxygen, carbon monoxide or dry carbon dioxide free plant air. The pressure in the nitrogen pipeline can vary, but in this example the pressure for stream 117' is set at 450 psig which is a common pressure level in transport pipelines. Current practice would have the nitrogen gas reduced in pressure through a pressure regulator or control valve 118 to the customer's pressure requirements in stream 119. The pressure of stream 119 in this example is 65 psig.

A letdown liquefaction unit 150 diverts nitrogen flow around letdown station 118. However, two separate companders 120 and 121 take advantage of larger nitrogen flows with the good pressure ratio available. Stream 122 taps off the pipeline stream 117' to feed the compressor section 123 of compander 120 which boosts the pressure of this stream 122'. After compression, an aftercooler 124 removes the heat of compression from stream 122' forming stream 125. Stream 125 enters the second compander 121 compressor 126 at approximately 100 degrees F. The compressor section 126 of compander 121 further compresses the stream 125 which is applied to a second aftercooler 124' forming stream 127. After exiting the second aftercooler 124', stream 127 at 710 psig and 100 degrees is fed to heat exchanger 128. Feed exchangers 128,129, and 130 respectively recover the refrigeration from stream 127 generated by the expanders 120 and 121 forming respective streams 128', 129' and 130'. Stream 131 splits off the main stream 128' after exiting heat exchanger 128 at 10 degrees F. Stream 131 has a flow of about 41% of stream 127. It enters expander section 132 of compander 120 where it is expanded forming stream 133 which has a resulting temperature of approximately minus 184 degrees F. with a pressure of 73 psig. Stream 133 is recombined with stream 141 exiting heat exchanger 130 forming stream 141' to recover its refrigeration in heat exchangers 129 and 128.

Stream 134 splits off the main circuit stream 129' from that exchanger 129 at approximately minus 175 degrees F. with about 44% of the flow of stream 127. It is expanded in expander section 135 of compander 121 which results in compander output stream 136 being almost 9% liquid nitrogen at 75 psig and minus 286 degrees F. The remaining portion stream 129" of high pressure nitrogen is cooled in heat exchanger 130 and exits as stream 130' at minus 280 degrees F. where it is then flashed through control valve 137. The resulting stream 138 is combined with stream 136 from the expander 135 and both are fed into separator 139 where saturated liquid and vapor are separated. Product liquid nitrogen stream 140 is removed from the separator 139 bottom. The cold gaseous nitrogen stream 141 is removed from the top of the separator 139 and applied in heat exchangers 130, 129, and 128 in succession to recover refrigeration forming stream 142 at the output of exchanger 128. The stream 141' is stream 141 exiting exchanger 130. Stream 142 exiting heat exchanger 128 is fed back into the nitrogen pipeline stream 119 to complete the diversion.

Stream 140 has a higher percentage of liquid product (about 19% of stream 127) produced than made in previous cases that only utilize one expander. This process is advantageous with good pressure ratios and larger nitrogen flow rates to generate a higher percentage of liquid product.

If power generation is desired, the expanders 132 and 135 can be fitted with electric generator brakes. The liquid produced will fall off, but power is generated.

The product liquid stream 140 in this example is used to liquid assist an air separation unit 25 to make liquid nitrogen 26, liquid oxygen 27, and liquid argon 28. Some or all of stream 140 could also be fed to a liquid nitrogen storage tank 143.

In operation, high pressure industrial gas (nitrogen, oxygen, carbon dioxide, natural gas or air from a pipeline is directed from the pressure letdown pressure regulators or control valve into the letdown liquefaction unit. For dry, carbon dioxide free nitrogen, oxygen and carbon monoxide, the gas enters directly into the unit. For air, a moisture/carbon dioxide absorption system is preferably employed to remove water and carbon dioxide. For natural gas, an absorption system is used to remove water from the entire stream; and another absorption system is used on a small fraction of the natural gas stream to remove carbon dioxide.

In simple letdown liquefaction units employing nitrogen, oxygen or carbon monoxide gas that supply these gases to consumers, the entire gas stream enters the letdown liquefaction unit through a main heat exchanger while cooling the feed stream down against the colder returning gas. At sufficiently cool temperatures, the entire stream is then preferably fed into an expansion turbine or another expansion device to extract energy from the stream and to provide refrigeration. A small portion of the stream (usually four to ten percent of the total stream) is converted to liquid product at the expander discharge. The mixed phase discharge is then preferably brought into a process separator to separate the gas and liquid phases. For nitrogen or oxygen, the liquid is kept as merchant product to be sold, and the cold gas is then returned to the main heat exchanger for the recovery of the refrigeration against incoming feed. Liquid nitrogen or liquefied oxygen product can be pumped cryogenically into product storage tanks or into an air separation unit to provide liquid assist. The liquid assist enhances the merchant liquid production of the air separation unit. The energy recovered from the expander can be used to generate electricity in the expander brake, or it can be used to drive a compressor or an oil brake.

If a compander is used, the feed stream can receive a pressure boost through the expander's compressor, or the exhaust stream going to the customer can receive a boost. Either way, the letdown liquefaction unit will experience increase pressure drop due to the compander, which provides additional refrigeration and additional liquid production. After exiting the letdown liquefaction unit, nitrogen, oxygen or carbon monoxide gas is fed back into the low pressure main, which provides the industrial gas customer with utility nitrogen, oxygen or carbon monoxide.

In nitrogen and oxygen pipeline situations, maximum power savings for letdown liquefaction are realized when the air separation unit and the compression equipment of the pipeline have excess capacity that is being vented to atmosphere by compression controls. This excess capacity is used to provide the nitrogen and oxygen molecules of the liquid nitrogen or liquid oxygen product. Excess capacity exists on most nitrogen and oxygen pipelines serving multiple customers. If compression controls are still venting excess nitrogen gas or oxygen gas capacity to atmosphere when the letdown liquefaction unit is operational, the letdown liquefaction unit will actually generate small amounts of power since the power for the air separation unit and pipeline compression remains unchanged.

However, if additional capacity requirements on the air separation unit and pipeline compression equipment occur due to the use of the letdown liquefaction unit implying less turndown on the compressor, then some increase in power will be experienced which can be attributed to the operation of the letdown liquefaction unit. The increase in power can still be well below the power required to manufacture liquid nitrogen or oxygen since turndown power recovery on compression equipment due to flow changes is only partial. Changes in atmospheric temperature especially in the late fall, winter and early spring also increases compression capacity that can now be utilized by the letdown liquefaction units instead of being vented to atmosphere by compression controls.

Many plant air situations also exist with excess compression capacity causing some plant air to be vented by compression controls. Venting occurs from system plant air pressure to atmospheric pressure. Letdown liquefaction units can be used here as well. The liquefaction unit is similar to the one designed for nitrogen and oxygen gas except water and carbon dioxide must first be removed in an air adsorption unit. After moisture and carbon dioxide removal, the plant air is cooled in a main exchanger, expanded, separated and removed in the main exchanger before being vented to the atmosphere and used for dryer regeneration. The liquid air is removed from the separator and pumped into an adjacent air separation unit where liquid nitrogen, oxygen and argon can be recovered due to the liquid assist from the letdown liquefaction unit. Production of liquid oxygen and liquid argon is especially enhanced since the liquid air from the separator is enriched in oxygen and argon. As with nitrogen and oxygen, the power required for the liquid production is minimal when plant air compression controls are venting and the letdown liquefaction unit is operational. More power will be attributed to the letdown liquefaction unit when compression turndown is not as great, but in most situations, the power to generate the merchant liquid products will still be well below the power required to make merchant liquid products by conventional means.

At some locations both natural gas and nitrogen gases are let down in pressure through pressure regulators and control valves. These locations can also be used for combination letdown liquefaction units to take advantage of both gases being reduced in pressure. As previously stated, all the natural gas is sent through a water removal adsorption system after coming off the high pressure gas main. A small portion is also sent to a carbon dioxide removal adsorption system after being dried. Being free of both water and carbon dioxide, the nitrogen gas enters the letdown liquefies without dryers. The large natural gas stream entering the letdown liquefaction unit is used for expansion while the small natural gas station fed into the letdown liquefaction unit is liquefied. Both these natural gas streams are chilled in the heat exchanger against cold natural gas returning from the natural gas expander. The large natural gas stream is removed at the proper temperature level and expanded to recover both energy and refrigeration.

After expansion, the large natural gas stream is used to further chill the small natural gas stream causing partial liquefaction of the small natural gas stream. The nitrogen gas stream is also divided into a large stream to be expanded and small stream to be liquefied. Both streams are cooled by cold returning nitrogen vapor and by vaporized/warming natural gas in another heat exchanger from the small natural gas stream. The large nitrogen stream is withdrawn from the heat exchanger and expanded with the exhaust being sent to a nitrogen separator. The smaller nitrogen stream is further chilled to approach liquefaction by returning cold nitrogen gas from the separators. The small nitrogen stream is flashed through a control valve and the resulting liquid nitrogen is collected in the separator.

Liquid nitrogen can then be pumped or drained into liquid nitrogen product storage or sent to an air separation unit for liquid assist. Natural gas is returned to the low pressure main which feeds the customer. Some is used to regenerate the adsorption system. The nitrogen gas is sent to the customer also in the low pressure utility nitrogen main.

It will occur to one of ordinary skill that various modifications may be made to the disclosed embodiments. These embodiments are given by way of illustration and not limitation. The number of heat exchangers, compressors, expanders, companders, separators, throttle valves and heat exchanger configurations is given by way of example. Other arrangements may also be applicable according to a given implementation. The multiple cascaded heat exchangers for example may be one unit with multiple channels in thermal conductive relation in multiple or single stages. It is intended that the scope of the invention is as defined in the appended claims.

What is claimed is:

1. A system for recovering refrigeration and energy from a relatively high pressure air or an air component gas supplied to a letdown station having an output stream supplied to a relatively low pressure atmosphere comprising:

heat exchanger means for receiving the pressurized air or air component gas supplied to the letdown station and for cooling the pressurized air or air component gas;

first expander means responsive to the cooled pressurized gas at a first output of the heat exchanger means applied thereto for expanding and further cooling the pressurized gas and for supplying a first portion of the further cooled pressurized gas to said heat exchanger means for the cooling of the received pressurized gas and for liquefying a second portion of the further cooled pressurized gas; and means for supplying said further cooled first portion of said pressurized gas at a second output of said heat exchanger means to said relatively low pressure atmosphere to thereby recover refrigeration from said first portion without the use of a compressor driven by a power source external to the system.

2. The system of claim 1 wherein the heat exchanger means has an input for receiving said pressurized air or gas upstream said letdown station and an output for supplying said first portion downstream said letdown station and storage means for storing said second portion.

3. The system of claim 1 including separator means responsive to the expanded cooled gas for separating said first and second portions.

4. The system of claim 1 further including an air separation means and means for supplying a third portion of said liquefied gas to said air separation means for assisting in separating air into component gases.

5. The system of claim 1 wherein the pressurized gas is selected from the group consisting of air, nitrogen, argon, carbon monoxide and oxygen.

6. The system of claim 5 wherein the pressurized gas is air, further including adsorbing means for drying and removing carbon dioxide from the pressurized air and for supplying the dried air to said heat exchanger means.

7. The system of claim 6 including means for regenerating said adsorbing means with the first portion of said gas outputted from the heat exchanger means.

8. The system of claim 1 including means coupled to the expander means for generating power.

9. The system of claim 2 including compressor means coupled to the expander means for compressing at least one of the received gas applied to the heat exchanger means and supplied first portion.

10. The system of claim 1 further including means responsive to pressurized natural gas applied to an input thereto for cooling the applied natural gas and applying the cooled natural gas to said heat exchanger means for cooling said air or air component.

11. The system of claim 10 including means for dividing said pressurized natural gas into a first relatively large stream and a relatively smaller second stream, said heat exchanger means comprising cascaded heat exchangers, a first portion of the cascaded heat exchangers for successively cooling and liquefying the smaller second stream, second expander means for expanding and cooling the natural gas larger first stream at an output of a second portion of said heat exchangers and for applying the expanded cooled natural gas first larger stream to a third portion of said cascaded heat exchangers for cooling said natural gas second smaller steam, and means for applying the liquefied natural gas to the first portion of said cascaded heat exchangers for cooling the smaller second stream and for applying the pressurized air or air component gas to a fifth portion of said heat exchangers including the first portion of said cascaded heat exchangers for cooling said air or air component by said cooled natural gas.

12. The system of claim 11 including separation means for separating cold vapor from liquid in said liquefied air or air component gas, and means for applying the cold vapor to said fifth portion of heat exchangers for cooling said air or air component gas.

13. The system of claim 12 wherein the first expander means is for expanding and liquefying a portion of the air or air component at the output of a sixth portion of the cascaded heat exchangers, the means for separating cold vapor for separating cold vapor from the last mentioned liquefied portion and applying the cold vapor from the liquefied last mentioned portion to said fifth portion of heat exchangers.

14. The system of claim 13 including compressor means driven by said first expander means for compressing warmed air or air component gas output of said fifth portion of cascaded heat exchangers and for returning the compressed warmed air or air component gas to said lower pressure output stream.

15. The system of claim 11 including drying means for drying said natural gas prior to formation of said first and second streams and means for regenerating the dryer means with said larger first portion of natural gas after it is expanded by the second expander means and applied to said third portion of said heat exchangers.

16. The system of claim 11 including $CO_2$ absorber means for removing $CO_2$ from said natural gas smaller second stream prior to applying said smaller stream to said cascaded heat exchangers and means for regenerating the $CO_2$ absorber means with said smaller second stream after it is passed through said first portion of cascaded heat exchangers in a direction in which it is cooled and then through the first portion of cascaded heat exchangers in a reverse direction in which it is warmed.

17. The system of claim 1 wherein the first expander means comprises a first expander and a second expander, the heat exchanger means comprising cascaded first, second and third heat exchangers, the pressurized air or air component gas being applied successively to said first, second and third heat exchangers in that order, the first expander for expanding and cooling said first portion at the output of the first heat exchanger and applying the expanded cooled gas successively to the second and first heat exchangers in that order for cooling a third portion of the gas applied to the first and second heat exchangers, the second expander for expanding and liquefying a fourth portion of said gas at the output of the cascaded first and second heat exchangers and including means for applying a cold vapor portion of the output of the second expander to said third, second and first cascaded heat exchangers in that order for cooling said pressurized gas applied to the cascaded heat exchangers and including throttling valve means for liquefying a fifth portion of said air or air component gas, said liquefied fourth and fifth portions forming said second portion.

18. The system of claim 17 including means for combining the expanded output of said second expander and output of said valve means for forming said second portion, and the means for applying the vapor including separator means for separating vapor from liquid in said second portion and for storing said separated liquid.

19. A system for recovering refrigeration and energy from a relatively high pressure air or an air component gas supplied to a letdown station having a lower pressure output stream comprising:

heat exchanger means for receiving the pressurized air or air component gas supplied to the letdown station and for cooling the pressurized air or air component gas;

first expander means responsive to the cooled pressurized gas at an output of the heat exchanger means applied thereto for expanding and further cooling the pressurized gas and for supplying a first portion of the further cooled pressurized gas to said heat exchanger means for the cooling of the received pressurized gas and for liquefying a second portion of the further cooled pressurized gas; and air separation means and means for supplying a third portion of said liquefied gas to said air separation means for assisting in separating air into component gases.

20. A system for recovering refrigeration and energy from a relatively high pressure air or an air component gas supplied to a letdown station having a lower pressure output stream comprising:

heat exchanger means for receiving the pressurized air or air component gas supplied to the letdown station and for cooling the pressurized air or air component gas;

first expander means responsive to the cooled pressurized gas at an output of the heat exchanger means applied thereto for expanding and further cooling the pressurized gas and for supplying a first portion of the further cooled pressurized gas to said heat exchanger means for the cooling of the received pressurized gas and for liquefying a second portion of the further cooled pressurized gas; and means responsive to pressurized natural gas applied to an input thereto for cooling the applied natural gas and applying the cooled natural gas to said heat exchanger means for cooling said air or air component.

21. A system for recovering refrigeration and energy from a relatively high pressure air or an air component gas supplied to a letdown station having a lower pressure output stream comprising:

heat exchanger means for receiving the pressurized air or air component gas supplied to the letdown station and for cooling the pressurized air or air component gas; and first expander means responsive to the cooled pressurized gas at an output of the heat exchanger means applied thereto for expanding and further cooling the pressurized gas and for supplying a first portion of the further cooled pressurized gas to said heat exchanger means for the cooling of the received pressurized gas and for liquefying a second portion of the further cooled pressurized gas;

the first expander means comprising a first expander and a second expander, the heat exchanger means comprising cascaded first, second and third heat exchangers, the pressurized air or air component gas being applied successively to said first, second and third heat exchangers in that order, the first expander for expanding and cooling said first portion at the output of the first heat exchanger and applying the expanded cooled gas successively to the second and first heat exchangers in that order for cooling a third portion of the gas applied to the first and second heat exchangers, the second expander for expanding and liquefying a fourth portion of said gas at the output of the cascaded first and second heat exchangers and including means for applying a cold vapor portion of the output of the second expander to said third, second and first cascaded heat exchangers in that order for cooling said pressurized gas applied to the cascaded heat exchangers and including throttling valve means for liquefying a fifth portion of said air or air component gas, said liquefied fourth and fifth portions forming said second portion.

* * * * *